United States Patent [19]

Goldie

[11] Patent Number: 4,890,836

[45] Date of Patent: Jan. 2, 1990

[54] BOWLING BALL INSERT

[76] Inventor: Steve D. Goldie, 278 Camino Lobo, Paso Robles, Calif. 93446

[21] Appl. No.: 280,234

[22] Filed: Dec. 5, 1988

[51] Int. Cl.[4] ..... A63B 37/00

[52] U.S. Cl. ..... 273/63 A; 273/63 E

[58] Field of Search ..... 273/63 R, 63 A, 63 B, 273/63 C, 63 D, 63 E, 63 F, 63 G, 128 A

[56] References Cited

U.S. PATENT DOCUMENTS

| | | | |
|---|---|---|---|
| 746,576 | 12/1903 | Rice | 273/63 E |
| 2,372,959 | 4/1945 | Keith | 273/63 B |
| 2,436,976 | 3/1948 | Seurynck | 273/63 B |
| 3,239,223 | 3/1966 | Mason | 273/63 B |
| 3,416,796 | 12/1968 | Ginder | 273/63 B |

*Primary Examiner*—George J. Marlo

*Attorney, Agent, or Firm*—Daniel C. McKown

[57] ABSTRACT

An insert that can be installed in a finger or thumb hole in a bowling ball after the existing hole has been enlarged includes a cylindrical tube of a resilient material. The space inside the tube is divided by a plenum and one end of the tube is closed by a plug to form a chamber within the tube between the plenum and the plug. A ballast material is included in this chamber to compensate for the weight of the ball material removed when the hole was enlarged to accommodate the insert, thereby bringing the ball back into balance. The insert is bonded into the enlarged hole with the chamber at the bottom of the hole. The resilient material of the tube provides a more comfortable grip on the ball. In the preferred embodiment, the plenum and the tube are a unitary structure.

4 Claims, 1 Drawing Sheet

BOWLING BALL INSERT

BACKGROUND OF THE INVENTION

1. Field of the Invention

The present invention relates to bowling balls and more specifically relates to an insert for a finger hole in the bowling ball.

2. The Prior Art

When a mass-produced bowling ball is picked up by a player, it is necessary for the player to squeeze the gripping surface, which is smooth and has a relatively low coefficient of friction. The player may experience some apprehension that the ball will slip from his grip, particularly during his delivery, and repeated deliveries can result in fatigue of the muscles of the hand that grips the ball. If the gripping surface were of a softer and more resilient material with a higher coefficient of friction, it would not be necessary for the player to grip the ball so tightly.

This and other considerations have led bowlers to experiment with various ways of modifying the grip holes in the ball. Generally, however, when material is removed from the walls of the finger grips, the ball tends to become unbalanced. The American Bowling Congress requires for sanctioned play that the balance of the ball must be within certain specifications, which are relatively stringent. Therefore, when the finger grip holes of a bowling ball are enlarged to accept an insert, care must be taken that the balance of the ball is not disturbed unacceptably.

A number of inventors have worked on this problem, and their patents will be briefly discussed in the following paragraphs.

In U.S. Pat. No. 746,576 issued Dec. 8, 1903, Rice shows threaded inserts in the finger holes of a bowling ball, with weights located in a smaller coaxial hole that extends diametrically through and beyond the center of a bowling ball. The weights are not part of the inserts, but instead appear to be packaged within their own casings.

In U.S. Pat. No. 4,289,312, issued Sept. 15, 1981 to Heimbigner, there is described a resilient insert for a bowling ball. The bore of the insert is formed with an oval shape that matches the shape of the user's fingertip.

In U.S. Pat. No. 4,623,149, issued Nov. 18, 1986 to Herman, there is shown a resilient insert, the bore of which is provided with a plurality of grooves that extend circumferentially around the bore and that permit the user to maintain a better grip.

In U.S. Pat. No. 3,454,440, issued July 8, 1969 to Vezirakis, there is described a method for casting an insert for the thumb hole that conforms exactly to the shape of the user's thumb.

The following patents describe weights that are included in a bowling ball and that are adjustable: U.S. Pat. No. 863,126 issued Aug. 13, 1907 to Wilson; U.S. Pat. No. 3,591,177 issued July 6, 1971 to Skuse; and, U.S. Pat. No. 4,099,715, issued July 11, 1978 to Caplan.

The following patents describe weight blocks for balancing a bowling ball: U.S. Pat. No. 4,320,899 issued Mar. 23, 1982 to Salvino and U.S. Pat. No. 4,655,454, issued Apr. 7, 1987 to Amburgey.

None of the above inventors seems to have come to grips with the problem addressed by the present inventor. That problem is as follows. An existing thumb or finger hole must be enlarged to permit installation of an insert, to accommodate the wall thickness of the insert (typically a few millimeters). This removal of material from the wall of the hole disturbs the balance of the ball. The balance is not restored by the weight of the insert, because the material of the insert is typically less dense than the material of the ball. Unless remedial measures are undertaken, the ball will be out of balance after the insert has been installed.

SUMMARY OF THE INVENTION

The present inventor found a convenient solution to this problem by providing a weight which is an integral part of the insert.

In the preferred embodiment, the weight is made up by providing a ballast material that is enclosed within a small compartment located just beyond the user's fingertip in the insert.

In accordance with the preferred embodiment, the weight of the ballast material should equal the weight of the ball material that was removed to accommodate the insert, minus the weight of the unballasted insert.

The novel features which are believed to be characteristic of the invention, both as to organization and method of operation, together with further objects and advantages thereof, will be better understood from the following description considered in connection with the accompanying drawings in which a preferred embodiment is to be expressly understood, however, that the drawings are for the purpose of illustration and description only and are not intended as a definition of the limits of the invention.

DETAILED DESCRIPTION OF THE PREFERRED EMBODIMENT

Figure 1:
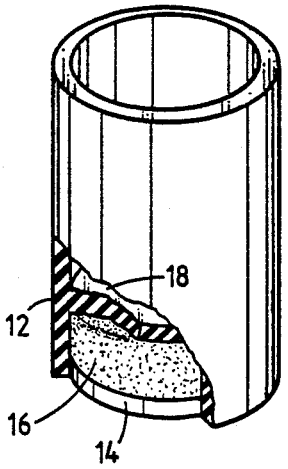
FIG. 1 is a perspective view showing a preferred embodiment of the present invention.

As shown in FIG. 1, in a preferred embodiment the insert of the present invention includes a sleeve 12, an end plug 14, and ballast material 16. The plenum 18 is a unitary part of the sleeve 12, and this insures that after the insert has been installed, none of the ballast material 16 can escape. The sleeve 12 including the plenum are molded of a silicone having a Shore hardness of 50. The sleeve is then inverted from the position shown in FIG. 1, the ballast material 16 is then loaded into place, and the end plug 14 is put in place. The end plug 14 can be made of a less durable material, since it needs to remain intact only until the insert has been installed. The material of the end plug 14 is not critical. In the preferred embodiment, the end plug 14 is a disk of plastic that is bonded to the sleeve 12 by a suitable adhesive.

Figure 2:
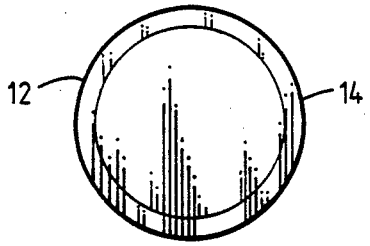
FIG. 2 is a bottom plan view of the embodiment of FIG. 1.
Figure 3:
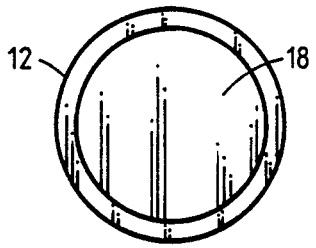
FIG. 3 is a top plan view of the embodiment of FIG. 1.

FIGS. 2 and 3 show the top and bottom views of the insert of FIG. 1.

Figure 4:
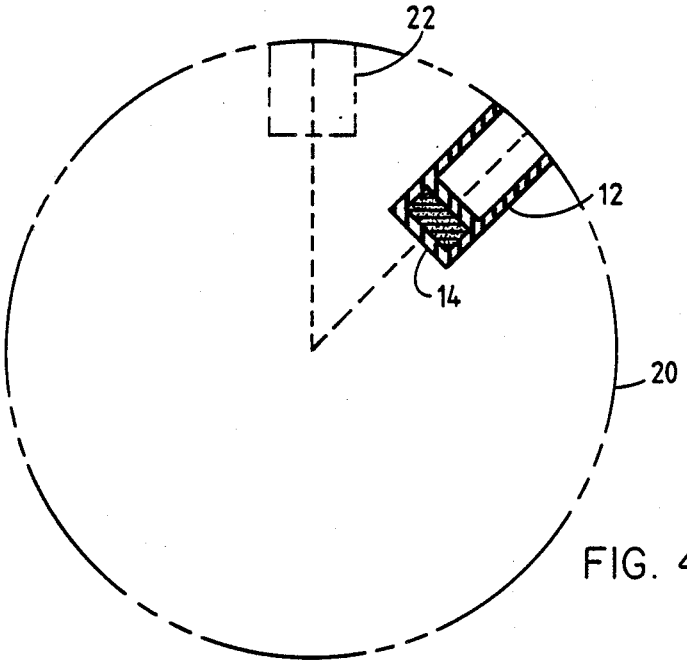
FIG. 4 is a cross-sectional view showing the embodiment of FIG. 1 installed in a bowling ball.

FIG. 4 shows how the insert is installed in a bowling ball 20. Initially, the hole in which the insert is to be installed looks like the unenlarged finger hole 22 that is present when the ball is purchased by the consumer. The original finger grip hole must be enlarged in diameter and made deeper to accommodate the insert. Thereafter, an adhesive is applied to at least part of the area of the enlarged hole and the insert is pushed into the hole. During this operation, the fact that the plenum 18 is a unitary part of the insert helps to prevent damage.

In the preferred embodiment, the ballast material is sand and in other embodiments lead shot is used.

The weight of ballast material can be varied from 0.25 ounce to 0.625 ounce without causing the ball to be unbalanced to an impermissible degree, and the slight amount of imbalance affects the amount by which the ball curves on its trajectory down the bowling alley. In this manner, the owner of the bowling ball can simultaneously provide the improved gripping surfaces as well as achieve a limited modification of the behavior of the bowling ball. In the preferred embodiment, the weight of ballast restores the original balance to the bowling ball, and it is only in the alternative embodiments that departures from the idea weight of ballast are made.

Thus, there has been described an insert to provide an improved gripping surface for the finger and thumb holes of a bowling ball and which can be installed in the bowling ball without affecting the balance of the ball. In alternative embodiments, slight alterations in the weight of the insert can be used to deliberately affect the dynamic characteristics of the ball.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An insert for a finger hole or thumb hole in a bowling ball comprising:

a tube of cylindrical form composed of a resilient material, having a first end and a second end, and a bore and a central axis;

a plenum located within said tube, extending in a plane perpendicular to the central axis of said tube and spanning the bore of said tube;

an end plug located at the first end of said tube and spanning the bore of said tube, whereby a closed chamber is defined within said tube between said plenum and said end plug.

2. The insert of claim 1 further comprising a quantity of a ballast material contained within the closed chamber.

3. The insert of claim 2 wherein the weight of said ballast material is sufficient to balance the bowling ball when the insert has been installed.

4. The insert of claim 1 wherein said tube and said plenum are parts of a unitary structure.

* * * * *